US010952912B2

(12) United States Patent
Xu et al.

(10) Patent No.: US 10,952,912 B2
(45) Date of Patent: Mar. 23, 2021

(54) CHAIR WITH ROTATABLE ARMREST

(71) Applicant: Zhejiang Fubang Technology Co. Ltd, Xiangshan (CN)

(72) Inventors: Xianguo Xu, Xiangshan (CN); Lei Xu, Xiangshan (CN)

( * ) Notice: Subject to any disclaimer, the term of this patent is extended or adjusted under 35 U.S.C. 154(b) by 36 days.

(21) Appl. No.: 16/504,352

(22) Filed: Jul. 8, 2019

(65) Prior Publication Data

US 2020/0397633 A1 Dec. 24, 2020

(30) Foreign Application Priority Data

Jun. 21, 2019 (CN) ..... 201910541568.7

(51) Int. Cl.
*A61G 5/12* (2006.01)
*A47C 7/54* (2006.01)

(52) U.S. Cl.
CPC ..... *A61G 5/125* (2016.11); *A47C 7/541* (2018.08); *A47C 7/543* (2013.01)

(58) Field of Classification Search
CPC ..... A61G 5/125; A61G 5/1081; A61G 7/051; A61G 7/0508; A47C 1/0308; A47C 7/543; A47C 20/023; B60N 2/753
USPC ..... 297/411.31
See application file for complete search history.

(56) References Cited

U.S. PATENT DOCUMENTS 1,902,709 A * 3/1933 King ..... A61G 5/00 297/411.31
3,048,857 A * 8/1962 Hutt ..... A61G 7/051 5/429
3,612,606 A * 10/1971 Swenson ..... A47C 7/543 297/411.31
3,883,175 A * 5/1975 Rodaway ..... A61G 5/1054 297/411.28
3,951,452 A * 4/1976 Harder, Jr. ..... B60N 2/753 297/411.31
4,013,135 A * 3/1977 Kechely ..... G01G 19/44 177/144
4,270,798 A * 6/1981 Harder, Jr. ..... A47C 7/543 297/411.31
5,171,317 A * 12/1992 Corcoran ..... A61H 1/0218 297/411.31
5,381,571 A * 1/1995 Gabhart ..... A61G 7/05 49/394

(Continued)

FOREIGN PATENT DOCUMENTS

CA 2447653 A1 * 12/2002 ..... A61G 7/1044
CA 2893490 A1 * 6/2014 ..... A61G 5/12

(Continued)

*Primary Examiner* — Timothy J Brindley
(74) *Attorney, Agent, or Firm* — HYIP

(57) ABSTRACT

The present disclosure provides a chair with a rotatable armrest, comprising a seat body, which is provided with an armrest, a backrest and a rotating member; wherein the backrest is arranged at a position on one end portion of the seat body, the rotating member is fixed on one end of the seat body near the backrest, the armrest is rotatablely connected with the seat body through the rotating member, and the armrest is capable of rotating roughly horizontally with respect to the seat body. According to the present disclosure, a user can leave the chair from one side of the seat body, moreover, when the user is leaving the chair, the rotated armrest can still provide help for the user.

7 Claims, 10 Drawing Sheets

(56) References Cited

U.S. PATENT DOCUMENTS

| | | | | |
|---|---|---|---|---|
| 6,289,539 | B1 * | 9/2001 | Alpern | A47C 21/08 5/659 |
| 6,343,805 | B1 * | 2/2002 | Roy | A61G 5/08 280/250.1 |
| 6,447,064 | B1 * | 9/2002 | Mundy | A61G 5/00 297/313 |
| 6,979,010 | B1 * | 12/2005 | Kwapis | A61G 5/1059 280/250.1 |
| 7,114,774 | B2 * | 10/2006 | Stahel | A47C 7/624 297/188.15 |
| 7,513,000 | B2 * | 4/2009 | DeBraal | A61G 13/0018 297/188.11 |
| D814,204 | S * | 4/2018 | Bova | D6/361 |
| 2003/0230868 | A1 * | 12/2003 | Beumer | A61G 5/1081 280/250.1 |
| 2006/0076818 | A1 * | 4/2006 | LaFreniere | A47C 7/546 297/411.36 |
| 2008/0093908 | A1 * | 4/2008 | Cooley | B60N 2/753 297/411.3 |
| 2010/0219617 | A1 * | 9/2010 | Murdock | A61G 5/042 280/642 |
| 2011/0074188 | A1 * | 3/2011 | Freer | B60N 2/753 297/188.14 |
| 2014/0183909 | A1 * | 7/2014 | Smith | A47C 1/0305 297/115 |
| 2017/0246061 | A1 * | 8/2017 | McClean | A61G 5/12 |

FOREIGN PATENT DOCUMENTS

| | | | | |
|---|---|---|---|---|
| CA | 2941579 | A1 * | 9/2015 | A61G 5/14 |
| WO | WO-2018169390 | A1 * | 9/2018 | A61G 7/1025 |

* cited by examiner

CHAIR WITH ROTATABLE ARMREST

TECHNICAL FIELD

The present disclosure relates to the field of medical rehabilitation appliances, and in particular to a chair with a rotatable armrest.

BACKGROUND

In order to facilitate the life of the old people and the people suffering special diseases, chairs are used sometimes. These chairs belong to medical rehabilitation appliances, which can provide help for the old people or the patients, for example, wheelchairs. Current chairs are provided with armrests on two sides thereof. Generally, a user can leave the chair from the front side of the chair only, and cannot leave the chair from one side of the seat body. Some armrests are capable of rotating vertically with respect to the seat body, allowing the user to leave the chair from one side of the seat body. However, the rotated armrests cannot continue providing help for the user.

SUMMARY

In view of the problems, the present disclosure provides a chair with a rotatable armrest; a user can leave the chair from one side of the seat body, moreover, when the user is leaving the chair, the rotated armrest can still provide help for the user.

The present disclosure provides a chair with a rotatable armrest, including:

a seat body, which is provided with an armrest and a backrest; wherein the chair is further provided with a rotating member, which is fixed on one end of the seat body near the backrest; wherein the armrest has one end rotatablely connected with the seat body through the rotating member, and the armrest is capable of rotating roughly horizontally with respect to the seat body.

Further, the armrest is provided with a first locating piece, the seat body is provided with a second locating piece, and the second locating piece fixes the armrest onto the seat body through the first locating piece.

Further, a reset spring is provided, and the reset spring is capable of driving the armrest to rotate to a position where the first locating piece may fit with the second locating piece.

Further, the chair includes a main beam and an underframe, wherein the main beam has a top end rotatablely connected with a position on an end portion of the seat body near the backrest, an adjustment member is provided between the seat body and the main beam, and the adjustment member is capable of adjusting an angle of the seat body relative to the main beam; the main beam has a bottom end rotatablely connected with the underframe, a damping spring is provided between the main beam and the underframe, and the damping spring is rotatablely connected with the main beam and the underframe.

Further, the adjustment member includes a first adjustment plate and a second adjustment plate, the first adjustment plate is connected with the seat body, the second adjustment plate is connected with the main beam, the first adjustment plate defines a first adjustment hole, the second adjustment plate defines a second adjustment hole, and an adjustment holt connects one first adjustment hole and one second adjustment hole so as to adjust an angle of the seat body relative to the main beam.

Further, the first adjustment plate is provided with a tension member, the second adjustment plate defines a plurality of third adjustment holes fitting with the tension member, and the tension member fits with one of the third adjustment boles to primarily locate the first adjustment plate onto the second adjustment plate.

Further, the tension member includes a spring and a locating ball, and the locating ball is connected with the spring.

Further, the chair is a wheelchair.

The chair with a rotatable armrest disclosed in the present disclosure has the following beneficial effects compared with the prior art.

The armrest is capable of rotating roughly horizontally with respect to the seat body, thus, a user can leave the chair from one side of the chair, moreover, since the armrest rotates roughly horizontally with respect to the seat body, the rotated armrest is located on one side of the seat body, with no change or little change in height; the user can still hold the armrest, and the armrest can still provide help for the user.

DESCRIPTION OF DESIGNATORS IN DRAWINGS OF SPECIFIC EMBODIMENTS

Figure 1:
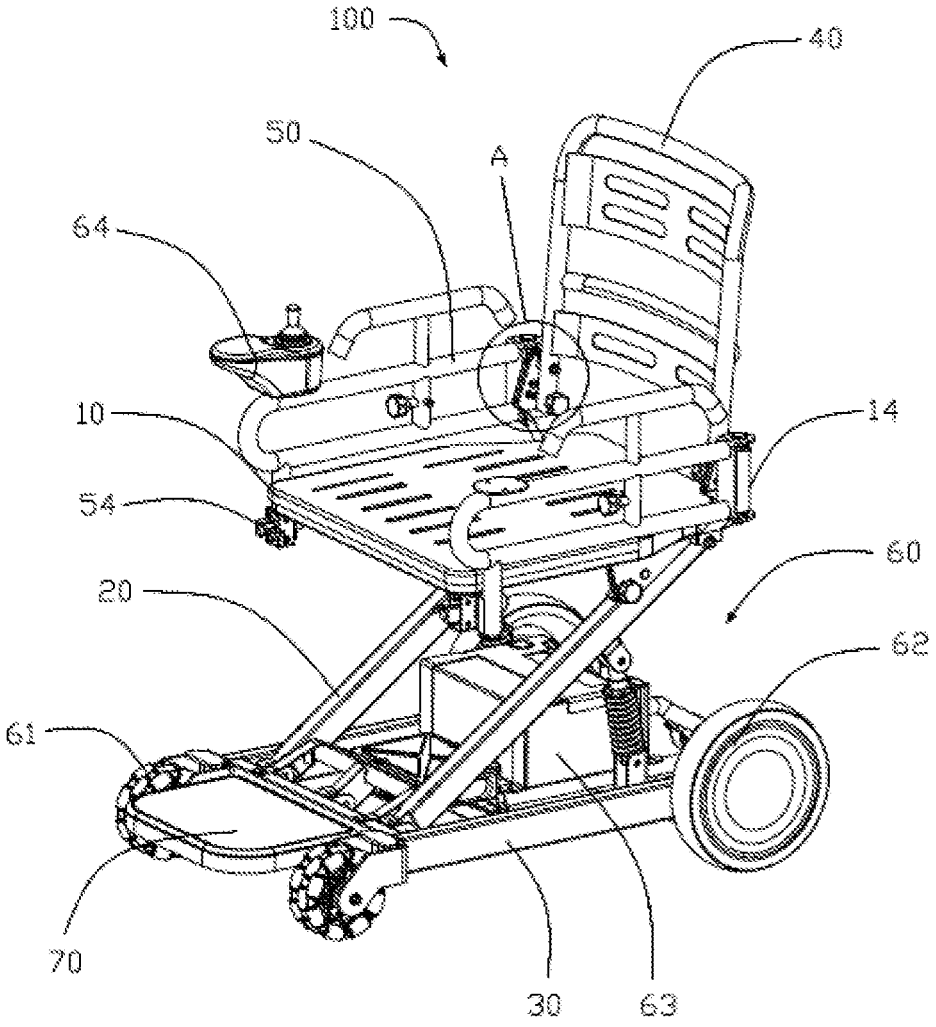
FIG. 1 is an overall structure diagram of a chair.

100 represents a chair, 10 represents a seat body, 11 represents an adjustment member, 111 represents a first adjustment plate, 112 represents a second adjustment plate, 113 represents a second adjustment hole, 114 represents a third adjustment hole, 12 represents an adjustment bolt, 13 represents a tension member, 131 represents a fixing shell, 132 represents a locating ball, 133 represents a spring, 14 represents a rotating member, 15 represents an adjustment plate, 151 represents a connection plate, 152 represents a reinforcement plate, 153 represents a second locating hole, 16 represents a second locating bolt, 17 represents a rotating shaft, 20 represents a main beam, 21 represents a damping spring, 211 represents a connecting piece, 30 represents an underframe, 40 represents a backrest, 50 represents an armrest, 51 represents a handhold member, 52 represents a lifting rod, 521 represents a first locating hole, 522 represents a limit groove, 53 represents a first locating piece, 54 represents a second locating piece, 55 represents a sleeve, 551 represents a first locating bolt, 552 represents a limit shaft, 60 represents a drive device, 61 represents a steering wheel, 62 represents a driving wheel, 63 represents a power supply, 64 represents a handle, 65 represents an overturn-preventing wheel, 651 represents an overturn-preventing bracket, and 70 represents a pedal plate.

DESCRIPTION OF THE EMBODIMENTS

A clear and complete description as below is provided for the technical scheme in the embodiments of the present disclosure in conjunction with the drawings in the embodiments of the present disclosure. It should be noted that when one component is viewed to be "connected" to another component, it may be directly connected to the another component, or an intermediate component may exist simultaneously. Unless defined otherwise, all technical and scientific terms used in this paper have the same meanings as commonly understood by one of ordinary skill in the art. It should be noted that, unless otherwise specifically stated and defined, terms such as "mounted", "interconnected", "connected", etc. should be interpreted expansively. For example, they may be fixed connection, also may be detachable connection, or integration; may be mechanical connection, also may be electrical connection, and may be internal communication between two elements. The ordinary skill in this field can understand the specific implication of the above terms in the present disclosure in accordance with specific conditions. In this paper, the terms used in the specification of the present disclosure are merely to describe specific embodiments, but to limit the present disclosure.

In the description of the present disclosure, it is to be noted that directional or positional relations indicated by terms such as "centre", "above", "below", "left", "right", "vertical", "horizontal", "inside", "outside", etc. are the directional or positional relations shown in the accompanying drawings, merely to conveniently describe the disclosure and simplify the description, but to indicate or imply the designated device or element to be constructed and operated in a specific position or in a specific direction. Therefore, the used directional or positional terms cannot be understood as a limit to the disclosure. In addition, terms such as "first", "second" and "third" are merely for the purpose of distinguishing, but cannot be understood as the indication or implication of relative importance.

As shown in FIG. 1, the present disclosure provides a chair 100 with a rotatable armrest, including a seat body 10, a main beam 20 and an underframe 30. The main beam 20 has two ends connected with the seat body 10 and the underframe 30 respectively, to form an overall frame of the chair 100; the seat body 10 is used for bearing an object; the seat body 10 is provided with a seat plate; and the underframe 30 serves as a support at the bottom, to play role of supporting. In the present embodiment, the chair 100 may be a medical rehabilitation appliance, for example, a manual wheelchair, or an electrically powered wheelchair.

The seat body 10 is provided with a backrest 40 and an armrest 50; the backrest 40 is arranged at a position on one end portion of the seat body 10, for a person sitting on the chair 100 to lean against. There are two armrests 50 provided, which are arranged on two sides of the seat body 10 respectively.

Figure 2:
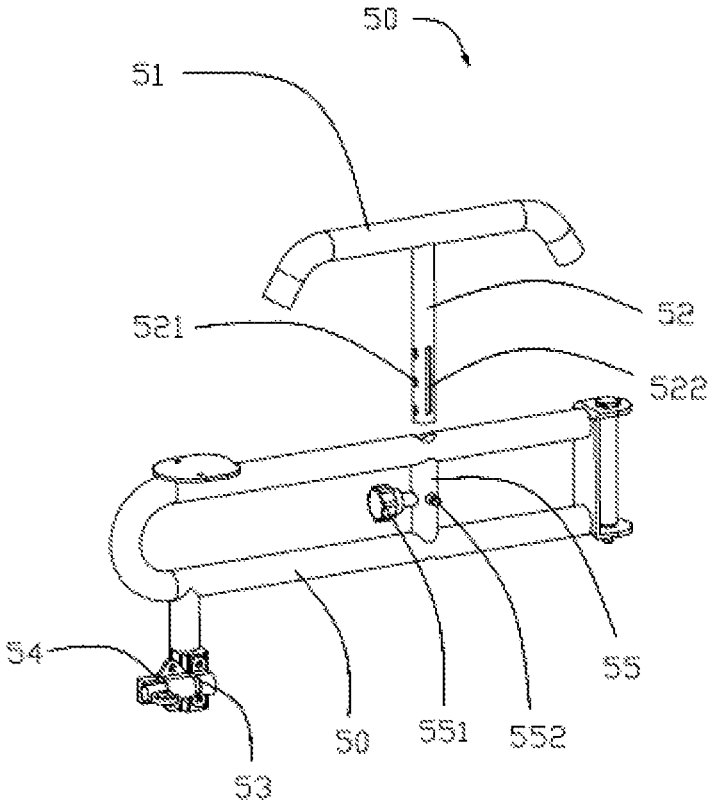
FIG. 2 is a structure diagram of an armrest.

Referring to FIG. 2, the seat body 10 is provided with a rotating member 14; the rotating member 14 is arranged at a position on one end portion of the seat body 10 near the backrest 40, and the rotating member 14 is integrated with the seat body 10; the armrest 50 has one end rotatablely connected with the seat body 10 through the rotating member 14, and the armrest 50 is capable of rotating roughly horizontally or rotating horizontally with respect to the seat body 10, In the present embodiment, the plane of rotation of the armrest 10 is parallel to an upper surface of the seat body 10. The armrest 50 is capable of rotating horizontally with respect to the seat body 10, to facilitate a user to leave the chair from the side of the chair, thereby providing conveniences for the people with mobility difficulties or suffering special diseases. Moreover, compared with the design that the armrest 50 rotates vertically with respect to the seat body 10, when a user is leaving the chair from one side of the seat body 10, the user may still hold the armrest 50.

The armrest 50 is provided with a first locating piece 53, and the seat body 10 is provided with a second locating piece 54. When the armrest 50 is not required to rotate, the second locating piece 54 may be fixedly connected with the first locating piece 53, thereby fixing the armrest 50 on the seat body 10 and preventing the armrest 50 rotating with respect to the seat body 10. When the armrest 50 is required to rotate, the second locating piece 54 is not fixed to the first locating piece 53, and one end of the armrest 50 may rotate with respect to the seat body 10 through the rotating member 14, so that a user may leave from one side of the seat body 10. In the present embodiment, the first locating piece 53 defines a pin hole, the second locating piece 54 is provided with a pin corresponding to the pin hole, and the pin fits with the pin hole to fix the first locating piece 53 and the second locating piece 54 together.

The chair 100 is further provided with a reset spring, and the reset spring is capable of driving the armrest 50 to rotate to a position where the first locating piece 53 may fit with the second locating piece 54. In the present embodiment, the reset spring has one end connected to the armrest 50 and the other end connected to the rotating member 14.

The armrest 50 is provided with a handhold member 51 and a lifting rod 52; the lifting rod 52 has a top end fixedly connected with the handhold member 51 and the other end extended into a sleeve 55 arranged on the armrest 50, the other end being capable of performing telescopic movement with respect to the sleeve 55; the armrest 50 is provided with a locating structure, and the locating structure is capable of making the lifting rod 52 extended/retracted to a certain position. The locating structure includes a first locating bolt 551 arranged on the sleeve 55 and a plurality of first locating holes 521 defined on the lifting rod 52; centers of the plurality of first locating holes 521 are in one same straight line; and the first locating bolt 551 fixes the lifting rod 52 and the sleeve 55 together through one of the first locating holes 521, preventing the lifting rod 52 against sliding with respect to the sleeve 55.

The sleeve 55 is provided with a limit shaft 552, the lifting rod 52 defines an elongated limit groove 522 extending along the sliding direction of the lifting rod 52, and the limit shaft 552 fits with the limit groove 522 to prevent the lifting rod 52 rotating with respect to the sleeve 55, Particularly when the lifting rod 52 performs telescopic movement with respect to the sleeve 55, the limit shaft 552 is capable of preventing the lifting rod 52 rotating with respect to the sleeve 55 through the limit groove 522, so that the first locating bolt 551 fixes the lifting rod 52 and the sleeve 55 together through one of the first locating holes 521.

Figure 3:
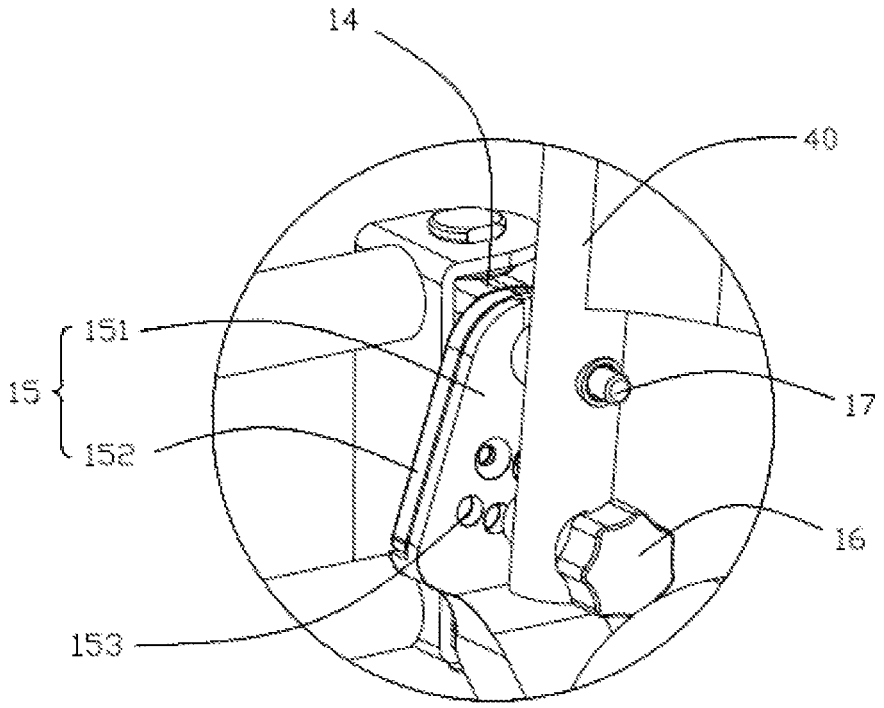
FIG. 3 is an enlarged diagram of a part A in FIG. 1.

Referring to FIG. 3, the seat body 10 is further provided with a connection plate 151 and a reinforcement plate 152, the connection plate 151 and the reinforcement plate 152 are combined to form an adjustment plate 15, the connection plate 151 is integrated with the rotating member 14, the backrest 40 is rotatablely connected with the seat body 10 through the adjustment plate 15, the adjustment plate 15 defines a plurality of second locating holes 153, the backrest 40 defines a third locating hole (not shown in drawings)

fitting with the second locating hole 153, and a second locating bolt 16 connects corresponding second locating hole 153 and third locating hole to adjust an angle of the backrest 40 relative to the seat body 10.

In order to reduce the overall weight of the chair 100, the overall frame of the chair 100 generally is made of aluminum alloy materials; when a user leans against the backrest 40, a certain force will be applied on the backrest 40; since the aluminum alloy has a relatively low strength, the arrangement of the reinforcement plate 152 can enhance the stability of the chair 100 when the user leans against the backrest 40. In the present embodiment, the reinforcement plate 152 is made of steel materials or copper materials or titanium alloy materials. The backrest 40 is connected with the adjustment plate 15 through a rotating shaft 17. The rotating shaft 17 has one end rotatablely connected with the backrest 40 and the other end fixedly connected with the reinforcement plate 152, which can enhance the stability of connection between the backrest 40 and the seat body 10.

The main beam 20 has two ends connected with the seat body 10 and the underframe 30 respectively. Specifically, several connection modes as follows exist between the main beam 20 and the seat body 10/the underframe 30.

Figure 4:
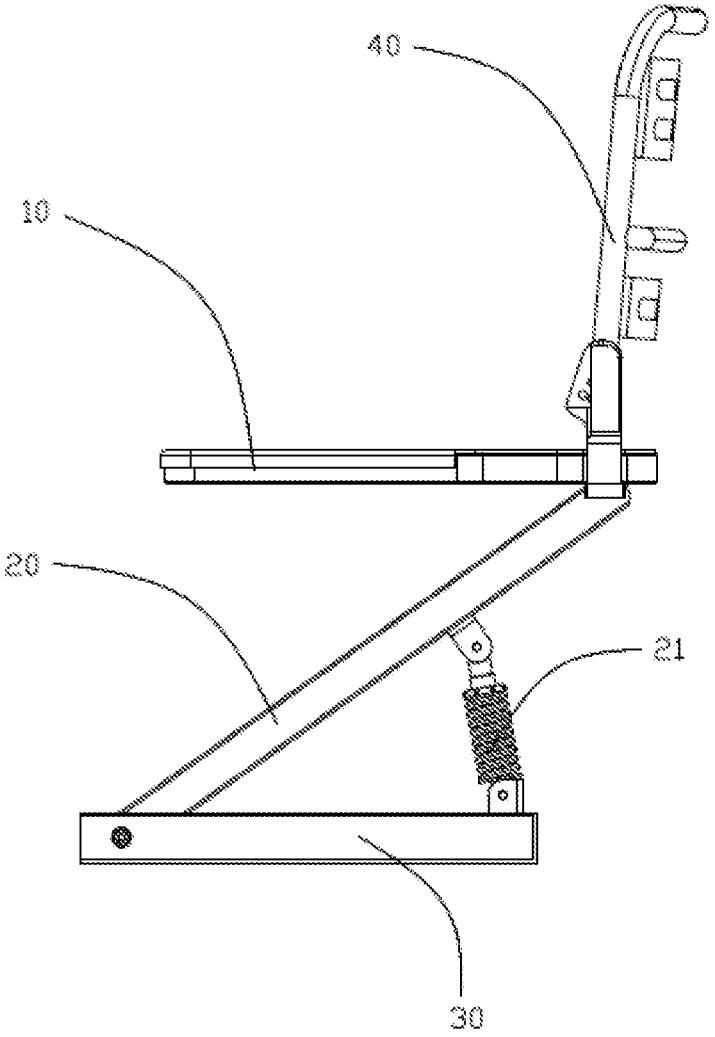
FIG. 4 is a first connection mode of a seat body, a main beam and an underframe.

As shown in FIG. 4, in a first embodiment, the main beam 20 has a top end connected with a position on one side of the seat body 10 near the backrest 40, and a bottom end rotatablely connected with the underframe 30; a damping spring 21 is provided between the main beam 20 and the underframe 30, and the damping spring 21 is rotatablely connected with the main beam 20 and the underframe 30.

Figure 5:
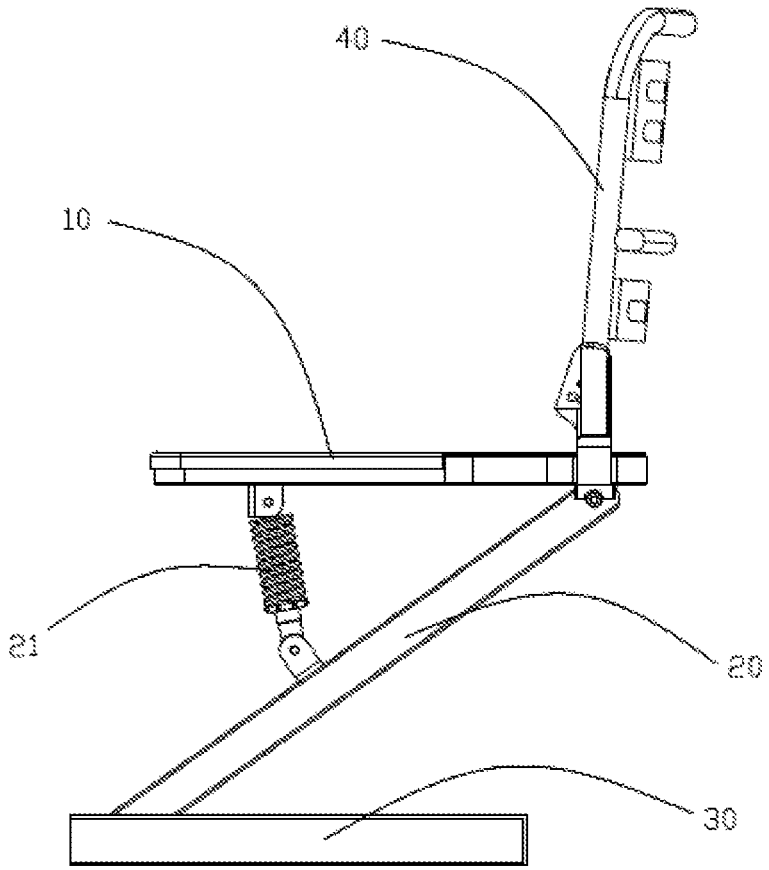
FIG. 5 is a second connection mode of a seat body, a main beam and an underframe.

As shown in FIG. 5, in a second embodiment, the main beam 20 has a top end rotatablely connected with a position on one side of the seat body 10 near the backrest 40, and a bottom end connected with the underframe 30; a damping spring 21 is provided between the seat body 10 and the main beam 20, and the damping spring 21 is rotatablely connected with the seat body 10 and the main beam 20.

Figure 6:
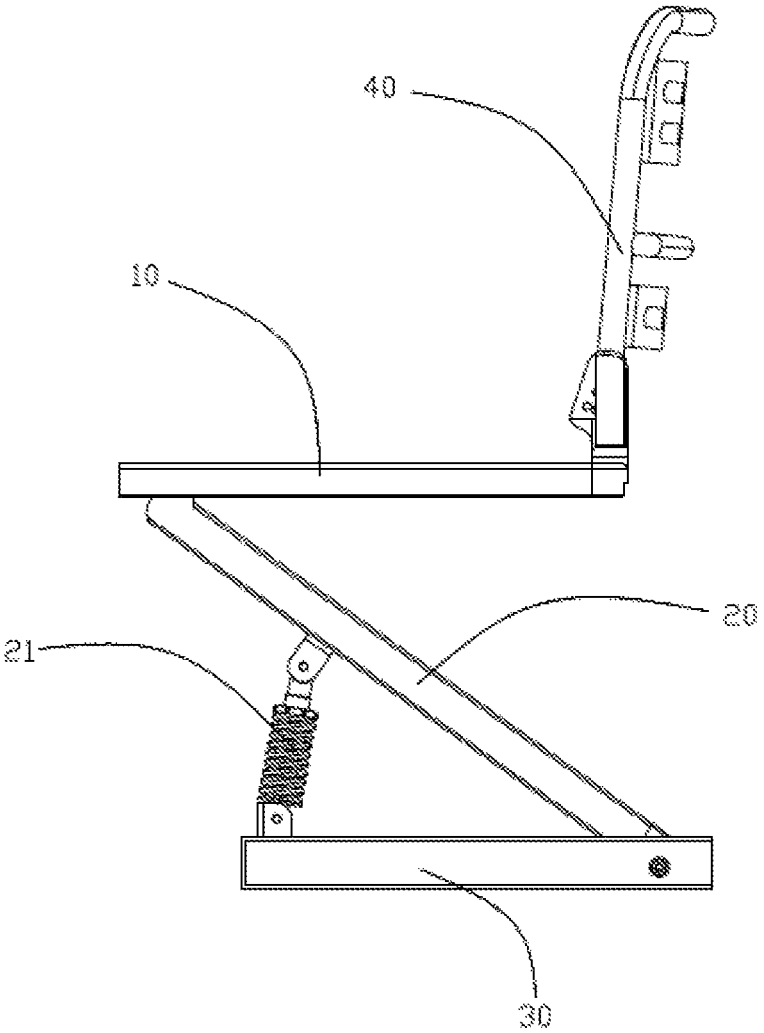
FIG. 6 is a third connection mode of a seat body, a main beam and an underframe.

As shown in FIG. 6, in a third embodiment, the main beam 20 has a top end connected with a position on one side of the seat body 10 far away the backrest 40, and a bottom end rotatablely connected with the underframe 30; a damping spring 21 is provided between the main beam 20 and the underframe 30, and the damping spring 21 is rotatablely connected with the main beam 20 and the underframe 30.

Figure 7:
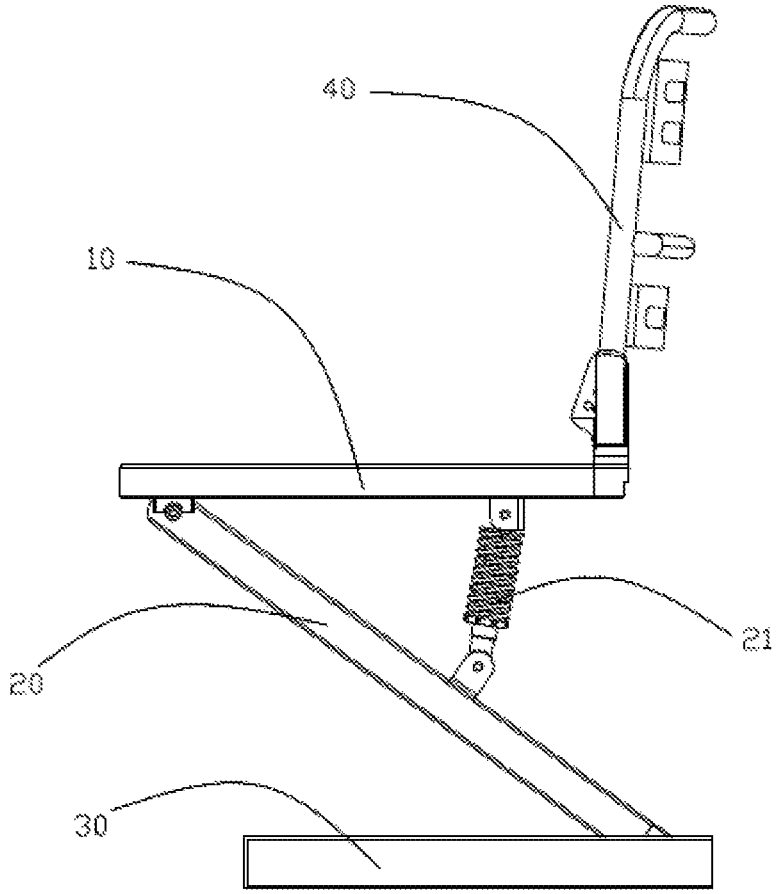
FIG. 7 is a fourth connection mode of a seat body, a main beam and an underframe.

As shown in FIG. 7, in a fourth embodiment, the main beam 20 has a top end rotatablely connected with a position on one side of the seat body 10 far away the backrest 40, and a bottom end connected with the underframe 30; a damping spring 21 is provided between the seat body 10 and the main beam 20, and the damping spring 21 is rotatablely connected with the seat body 10 and the main beam 20.

Figure 8:
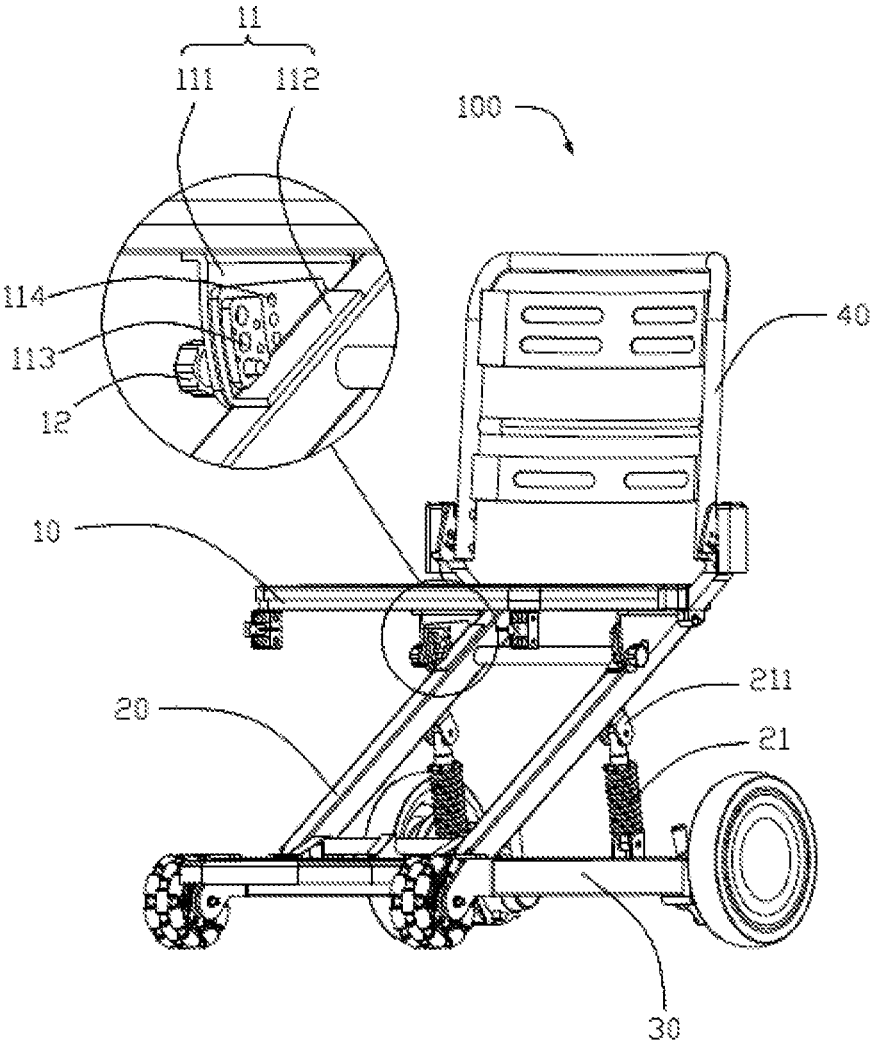
FIG. 8 is a structure diagram of a chair when no armrest is mounted.

As shown in FIG. 8, in the present embodiment, the main beam 20 has a top end connected with one end of the seat body 10 near the backrest 40, and the main beam 20 has a bottom end rotatablely connected with the underframe 30. The damping spring 21 has two ends rotatablely connected with the main beam 20 and the underframe 30 through a connecting piece 211 respectively. When a user sits on the seat body 10, a downward force is applied on the seat body 10, the seat body 10 applies a downward force on the main beam 20, and the main beam 20 may rotate around the bottom end thereof, thereby preloading the damping spring 21; then, the damping spring 21 applies an upward force on the main beam 20, to achieve an effect of buffering and damping. The damping spring 21 has two ends rotatablely connected with the main beam 20 and the underframe 30 through a connecting piece 211 respectively. When the main beam 20 rotates, the damping spring 21 adjusts position automatically, to achieve a best damping effect.

The seat body 10 has a position on one side near the backrest 40 rotatablely connected with a top end of the main beam 20 through a rotating shaft, an adjustment member 11 is provided between the seat body 10 and the main beam 20, the adjustment member 11 includes a first adjustment plate 111 and a second adjustment plate 112, the first adjustment plate 111 is fixedly connected with the seat body 10, and the second adjustment plate 112 is fixedly connected with the main beam 20. The first adjustment plate 111 adjusts its position fixed on the second adjustment plate 112, to adjust an angle between the seat body 10 and the main beam 20, so that a sitting posture of the user may be changed and the practicability of the chair is improved.

The first adjustment plate 111 defines a first adjustment hole (not shown in drawings), the second adjustment plate 112 defines a plurality of second adjustment holes 113, centers of the plurality of second adjustment holes 113 are on one same arc, and an adjustment bolt 12 fixes the first adjustment plate 11 at a certain position on the second adjustment plate 112 through the first adjustment hole and one of the second adjustment holes 113; the adjustment bolt 12 fits with different second adjustment holes 113 to change a position where the first adjustment plate 111 is fixed on the second adjustment plate 112, thereby changing an angle of the seat body 10 relative to the main beam 20.

Figure 9:
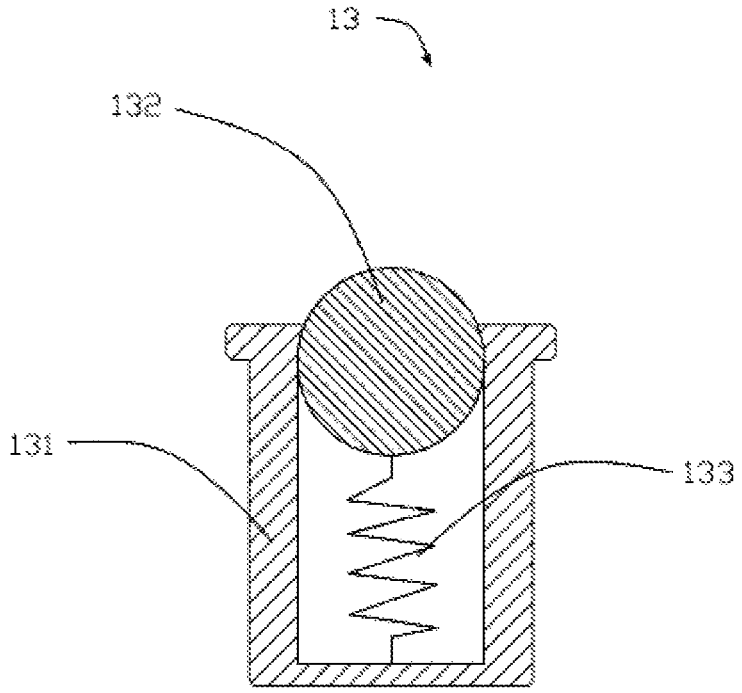
FIG. 9 is a structure diagram of a tension member.

Referring to FIG. 9, in order to facilitate the adjustment bolt 12 to fit with the first adjustment hole and the second adjustment hole 113, the first adjustment plate 111 is provided with a tension member 13, the second adjustment plate 112 is provided with a plurality of third adjustment holes 114 fitting with the tension member 13, centers of the plurality of third adjustment holes 114 are on one same arc, the tension member 13 primarily locates the first adjustment plate 111 onto the second adjustment plate 112 through one of the third adjustment holes 114, and then the adjustment bolt 12 corresponds to positions of the first adjustment hole and the second adjustment hole 113, so that the adjustment bolt 12 can fix the first adjustment plate 111 and the second adjustment plate 112 together through the first adjustment hole and the second adjustment hole 113.

The tension member 13 includes a fixing shell 131, a locating ball 132 and a spring 133; the fixing shell 131 is fixedly connected with the adjustment plate 111, the locating ball 132 is connected with the fixing shell 131 through the spring 133, and the locating ball 132 may extend into the fixing shell 131.

Figure 10:
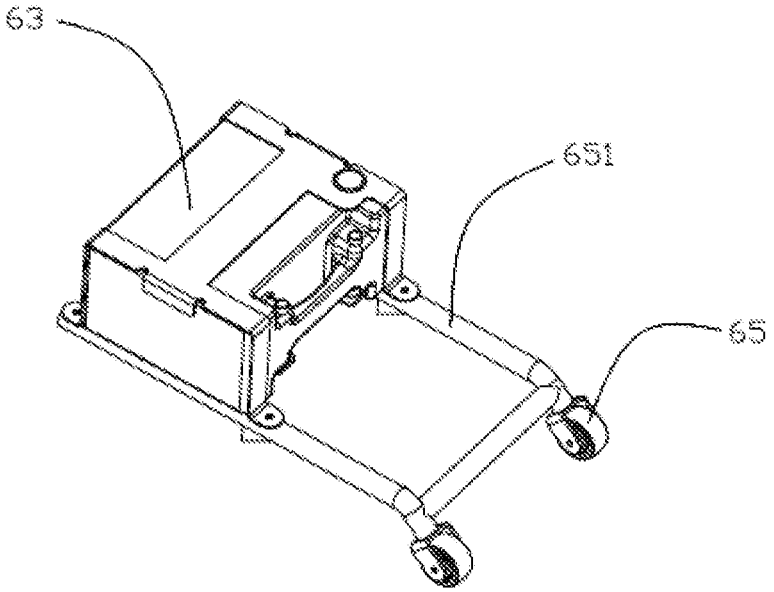
FIG. 10 is a structure diagram of an overturn-preventing wheel and an overturn-preventing bracket.

As shown in FIG. 1, when the chair 100 is an electrically powered wheelchair, the chair 100 is further provided with a drive device 60, and the drive device 60 may drive the underframe 30 to move. The drive device 60 includes a steering wheel 61, a driving wheel 62, a power supply 63, a handle 64 and an overturn-preventing Wheel 65. There are two steering wheels 61 provided, which are rotatablely connected with one end of the underframe 30 corresponding to each other. The steering wheel 61 may be a universal wheel, also may be an omni-directional wheel. There are two driving wheels 62 provided, which are provided on the other end of the underframe 30 corresponding to each other. The driving wheel 62 is provided with a drive motor and a brake device. The drive motor may drive the driving wheel 62 to rotate, and the brake device may automatically brake the driving wheel 62. Moreover, the drive motor and the brake device are both electrically connected with the power supply 63. The handle 64 is arranged on the armrest 50, which is convenient for a user to use. Moreover, the handle 64 is electrically connected with the power supply 63. As shown in FIG. 10, the overturn-preventing wheel 65 is arranged in the rear of the chair through an overturn-preventing bracket 651, being capable of preventing the chair overturning towards one side. The overturn-preventing bracket 651 is fixedly connected with the underframe 30, and the power supply 63 is fixed on the overturn-preventing bracket 651.

The underframe 30 is further provided with a pedal plate 70 for two feet to place; the pedal plate 70 is hinged with the underframe 30, and the pedal plate 70 may rotate by a certain angle relative to the underframe 30.

The present disclosure may be designed to be many embodiments and transformations without departing from the general spirit and scope of the present disclosure. The above embodiments are merely to illustrate the present disclosure, but to limit the scope of the present disclosure.

What is claimed is:

1. A chair with a rotatable armrest, comprising:

a seat body, which is provided with an armrest and a backrest; wherein the chair is further provided with a rotating member, which is fixed on one end of the seat body near the backrest; wherein the armrest has one end rotatablely connected with the seat body through the rotating member, and the armrest is capable of rotating roughly horizontally with respect to the seat body, the chair further comprises a main beam and an underframe, the main beam has a top end rotatablely connected with a position on an end portion of the seat body near the backrest, an adjustment member is provided between the seat body and the main beam, and the adjustment member is capable of adjusting an angle of the seat body relative to the main beam; the main beam has a bottom end rotatablely connected with the underframe, a damping spring is provided between the main beam and the underframe, and the damping spring is rotatablely connected with the main beam and the underframe.

2. The chair with a rotatable armrest according to claim 1, wherein the armrest is provided with a first locating piece, the seat body is provided with a second locating piece, and the second locating piece fixes the armrest onto the seat body through the first locating piece.

3. The chair with a rotatable armrest according to claim 2, wherein a reset spring is further provided, and the reset spring is capable of driving the armrest to rotate to a position where the first locating piece may fit with the second locating piece.

4. The chair with a rotatable armrest according to claim 3, wherein the adjustment member comprises a first adjustment plate and a second adjustment plate, the first adjustment plate is connected with the seat body, the second adjustment plate is connected with the main beam, the first adjustment plate defines a first adjustment hole, the second adjustment plate defines a second adjustment hole, and an adjustment holt connects one first adjustment hole and one second adjustment hole so as to adjust an angle of the seat body relative to the main beam.

5. The chair with a rotatable armrest according to claim 4, wherein the first adjustment plate is provided with a tension member, the second adjustment plate defines a plurality of third adjustment holes fitting with the tension member, and the tension member fits with one of the third adjustment holes to primarily locate the first adjustment plate onto the second adjustment plate.

6. The chair with a rotatable armrest according to claim 5, wherein the tension member comprises a spring and a locating ball, and the locating ball is connected with the spring.

7. The chair with a rotatable armrest according to any one of claims 1 to 3 or 4 to 6, wherein the chair is a wheelchair.

* * * * *